United States Patent [19]

Birchenough

[11] 4,001,602

[45] Jan. 4, 1977

[54] ELECTRONIC ANALOG DIVIDER

[75] Inventor: Arthur G. Birchenough, Brookpark, Ohio

[73] Assignee: The United States of America as represented by the Administrator of the National Aeronautics and Space Administration, Washington, D.C.

[22] Filed: July 24, 1975

[21] Appl. No.: 598,968

[52] U.S. Cl. ..... 307/229; 307/230; 328/161

[51] Int. Cl.[2] ..... G06G 7/12; G06G 7/16

[58] Field of Search ..... 307/229; 328/161; 235/184, 196

[56] References Cited

UNITED STATES PATENTS

| | | | |
|---|---|---|---|
| 2,560,170 | 7/1951 | Gray | 328/161 |
| 3,130,323 | 4/1964 | Swain | 235/196 |
| 3,146,346 | 8/1964 | Evangelisti et al. | 235/184 |
| 3,152,250 | 10/1964 | Platzer, Jr. | 307/229 |
| 3,274,381 | 9/1966 | Amano et al. | 235/196 |

*Primary Examiner*—Stanley D. Miller, Jr.
*Assistant Examiner*—B. P. Davis
*Attorney, Agent, or Firm*—N. T. Musial; J. A. Mackin; J. R. Manning

[57] ABSTRACT

Advantage is taken of the current-exponential voltage characteristic of a diode over a certain range whereby the incremental impedance across the diode is inversely proportional to the current through the diode. Accordingly, a divider circuit employs a bias current through the diode proportional to the desired denominator and applies an incremental current to the diode proportional to the numerator. As a result, the incremental voltage across the diode is proportional to the quotient.

8 Claims, 3 Drawing Figures

ELECTRONIC ANALOG DIVIDER

The invention described herein was made by an employee of the U.S. Government and may be manufactured and used by or for the Government for governmental purposes without the payment of any royalties thereon or therefore.

BACKGROUND OF THE INVENTION

1. Field of the Invention

The invention relates to analog calculators.

2. Description of the Prior Art

Many divider circuits are known. Some of these use log and antilog techniques, or multipliers with a feedback loop incorporating an operational amplifier. Frequently, they are inaccurate at low denominator voltages unless complicated circuits are employed to insure accuracy.

SUMMARY OF THE INVENTION

According to the present invention, a relatively simple circuit is employed which enjoys substantial accuracy at relatively low denominator (divisor) values. The invention employs the known exponential characteristic of a diode where, particularly at low forward voltages and currents, the current is an exponential function of the voltage applied across the diode, and the incremental impedance of the diode is therefore inversely proportional to the current through the diode. Accordingly, the diode bias current is made proportional to the desired denominator, and the incremental signal current is applied across the diode as a numerator, whereby the resultant incremental voltage across the diode is proportional to the desired quotient.

BRIEF DESCRIPTION OF THE DRAWINGS

The invention will be more fully understood from the following detailed description when read in connection with the accompanying drawing in which.

DETAILED DESCRIPTION

Figure 1:
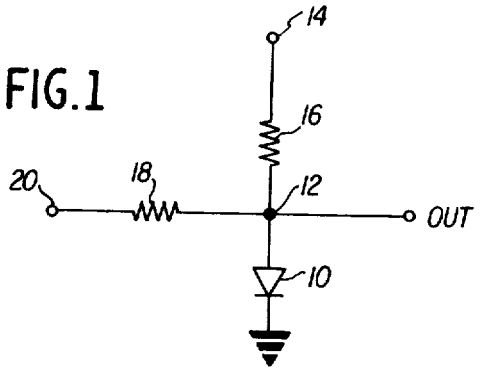
FIG. 1 is a schematic diagram of a simple embodiment of the invention useful for an A. C. (alternating current) coupled numerator signal and helpful in explaining the invention.

Referring now to FIG. 1, a diode 10 has its anode connected to a junction 12 and its cathode connected to ground or a common connection, indicated by the conventional ground symbol. The current proportional to the desired denominator is applied via terminal 14 through a resistor 16 and the diode 10 to ground. Between terminal 20 and ground is applied an incremental voltage proportional to the desired numerator. The output is taken between junction 12 and ground, as indicated.

In operation the current I from terminal 14 through the diode 10 is proportional to the desired denominator. The incremental impedance across the diode, say dV/dI, where V is the voltage across the diode is inversely proportional to the diode current I, because the diode current lies in the range in which the diode current is an exponential function of the diode voltage.

The incremental current applied to the diode is proportional to the incremental voltage input applied between terminal 20 and ground. The resultant voltage across the diode is then proportional to the product of the incremental current applied at terminal 20 which is proportional to the incremental voltage at terminal 20, and the impedance of the diode. In this simple circuit, the voltage applied at terminal 20 should be applied through a blocking condenser (not shown). It is also assumed that the output is applied to a high impedance circuit, such as a high impedance amplifier. Further, the denominator current applied through resistor 16 should be much greater in value than the incremental current through the diode 10 (by which is meant at least ten times) to assure that the incremental current flow through diode 10 from terminal 20 is indeed proportional to the desired numerator and lies along the slope of the current voltage characteristic.

Figure 2:
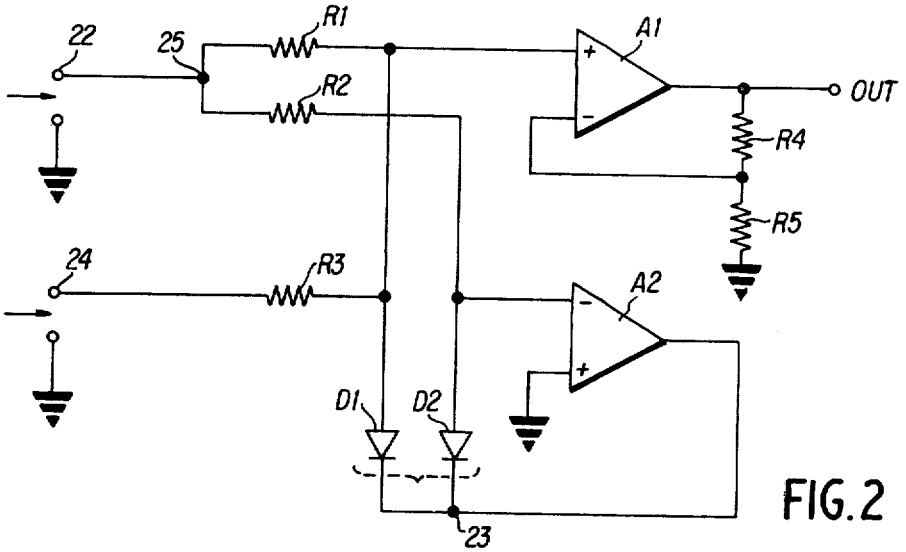
FIG. 2 is a schematic diagram of an embodiment of the invention for D. C. (direct current) incorporating a temperature compensation arrangement.

Referring now to FIG. 2, a voltage is applied between terminal 22 and ground which is proportional to the desired denominator. The current from terminal 22 divides at junction 25 and flows through first and second resistors R1 and R2. The terminals of resistors R1 and R2 remote from junction 25 are respectively connected to the anodes of first and second diodes D1 and D2. Preferably the diodes are of the same type with identical voltage-current characteristics and in close thermal coupling, as indicated by the dotted bracket. The diodes may, of course, be replaced by diode connected transistors. The diode cathodes are joined at a junction 23. The resistor R1 is connected in series with diode D1 and resistor R2 is connected in series with diode D2, each resistor being connected in series with its corresponding diode. The two series circuits are connected in parallel, one junction 25 of the parallel circuit joining the resistors R1 and R2 and the other junction 23 joining the cathodes of diodes D1 and D2. The output of an amplifier A2, the positive polarity (non-inverting) input of which is connected to ground as indicated by the conventional ground symbol, and the negative polarity (inverting) terminal of which is connected to the anode of the second diode D2 is connected to the diode cathodes at 23. The negative polarity input to the amplifier is connected to the diode D2 anode.

A voltage proportional to the desired numerator is applied between terminal 24 and ground. A resistor R3 has one of its terminal connected to terminal 24 and the other to the anode of diode D1. The anode of diode D1 is also connected to the positive input terminal of an amplifier A1, the output of which is the output terminal of the circuit. The output terminal of the amplifier A1 is also connected to one terminal of resistor R4. The other terminal of resistor R4 is connected to the negative input terminal of the amplifier A1, and at a junction to one terminal of a resistor R5, the other terminal of which is connected to ground.

In the circuit of FIG. 2, assume that the resistors R1 and R2 are of the same value. The voltage applied at terminal 22 must be positive in value. Consequently, amplifier A2 will draw current through diodes D1 and D2 until the junction between resistor R2 and diode D2 (that is, the voltage at the anode of diode D2) is at ground voltage. At the same time, assuming negligible current loss through amplifier A1, which may have a high input impedance, the current contribution to diode D1 through resistor R1 and diode D1 will be the same as that through resistor R2 and diode D2. The current through diode D1 (as well as that through diode D2) from resistor R1 is now proportional to the voltage applied at input terminal 22, and the impedance of the diode D1 is inversely proportional to the denominator input. The numerator voltage is applied at terminal 24. If there is no voltage applied at 24, the currents in diodes D1 and D2 are equal for matched diodes independent of denominator current greater than zero. The quotient is proportional to the difference in diode voltage and is, therefore, zero. Assuming that the value of resistor R3 is appropriately selected to be adequately large to prevent large undesired inequality in diode denominator currents, the incremental current from resistor R3 from terminal 24 through the diode D1 is proportional to the numerator. Consequently, the voltage difference across diodes D1 and D2 is now proportional to the product of the current from resistor R3 and the impedance of diode D1 which is proportional to the inverse of the denominator. A resultant voltage proportional to the desired quotient is developed and sensed by the amplifier A1, the output of which develops a voltage proportional to the quotient across resistors R4 and R5. The gain of amplifier A1 is determined by the ratio of resistors R4 and R5, the voltage developed at D1 may, for example, be on the order of millivolts and is amplified by amplifier A1 to produce a higher output.

The circuit of FIG. 2 is particularly well adapted to being embodied in integrated form. All the components of FIG. 2 can be readily integrated on a single chip. With diodes D1 and D2 in close proximity they are, of course, in close thermal relationship. With diodes D1 and D2 similarly integrated on the same chip and resistors R1 and R2 of like value on the same chip, the circuit affords temperature compensation and performs well over a relatively broad range of denominator values.

Figure 3:
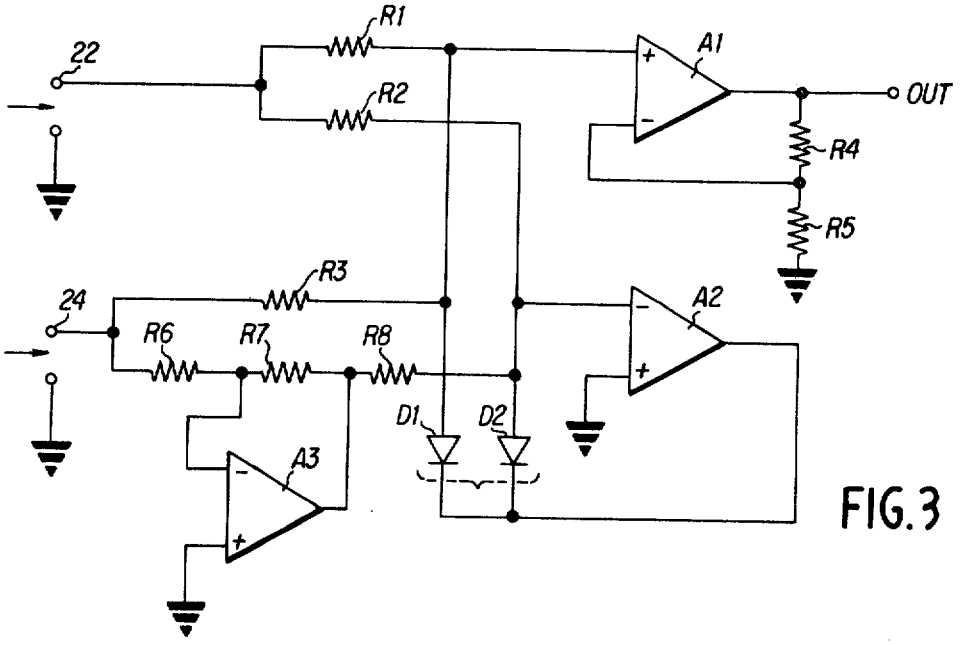
FIG. 3 is a schematic diagram of a further embodiment of the invention similar to that of FIG. 2, but with some additions.

Referring to FIG. 3, in which parts corresponding to those in FIG. 2 bear like reference numerals, the arrangement and operation is similar to that in FIG. 2, except as follows:

Three serially connected resistors R6, R7 and R8 are connected between terminal 24, to which one terminal R6 is connected, and the anode of diode D2, to which one terminal of resistor R8 is connected. The junction between resistors R6 and R7 is connected to the negative input terminal of an amplifier A3, and the output of amplifier A3 is connected to the junction between resistors R7 and R8. The other positive input terminal of A3 is connected to ground.

The arrangement in FIG. 3 provides a differential numerator-incremental current so that the current through the diodes D1 and D2 more accurately reflects the current value of the denominator and at the same time the additional current in D1 reflects the incremental current corresponding to the numerator.

Four quadrant operation may be obtained by using two additional diodes connected in inverse parallel with diodes D1 and D2. Resistors R1 and R2 serve to act as high impedance current sources. Accuracy at very low denominator inputs can be improved by using high impedance current sources, such as those which employ active circuits, in place of resistors R1 and R2.

What is claimed is:

1. A divider circuit comprising a pair of resistors, a pair of diodes, each resistor being connected in series with a corresponding diode and the two series circuits thereby formed being connected in parallel, the resistors connected to form one junction of the parallel circuits, means for applying to said one junction a current proportional to a desired denominator in the exponential voltage-current characteristic of the diode, whereby the current through the diodes is proportional to said denominator, means for applying to one of said diodes an incremental current proportional to a desired numerator, and an amplifier, one input to said amplifier comprising the connection between said other diode and its corresponding resistor, the output of said amplifier being connected to the diode junction of said parallel circuits, and the other amplifier input being connected to a common terminal.

2. A circuit as claimed in claim 1 wherein the diodes are substantially the same in characteristics.

3. A circuit as claimed in claim 1 wherein the diodes are in close thermal coupling.

4. A circuit as claimed in claim 1 wherein the said resistors are of equal value, and the said diodes are in close thermal coupling.

5. A circuit as claimed in claim 1 said means for applying numerator current to said one of said diodes comprising a resistor.

6. A circuit as claimed in claim 5, further comprising an amplifier connected with an input and an output across said numerator applying resistor.

7. A divider circuit as claimed in claim 1, the said two series circuits having substantially equal characteristics whereby the voltage difference between the voltage across the diodes is proportional to the numerator voltage.

8. The divider circuit of claim 1 wherein each said pair of resistors is replaced by a high impedance current source.

* * * * *